US008349095B2

(12) United States Patent
Nakano et al.

(10) Patent No.: US 8,349,095 B2
(45) Date of Patent: Jan. 8, 2013

(54) SPRING STEEL AND SPRING HAVING SUPERIOR CORROSION FATIGUE STRENGTH

(75) Inventors: Tomohiro Nakano, Nagoya (JP); Takanori Kuno, Nagoya (JP); Takayuki Sakakibara, Nagoya (JP); Masami Wakita, Nagoya (JP); Shingo Mimura, Nagoya (JP)

(73) Assignee: Chuo Hatsujo Kabushiki Kaisha, Nagoya-Shi (JP)

( * ) Notice: Subject to any disclaimer, the term of this patent is extended or adjusted under 35 U.S.C. 154(b) by 88 days.

(21) Appl. No.: 12/892,445

(22) Filed: Sep. 28, 2010

(65) Prior Publication Data

US 2011/0074078 A1 Mar. 31, 2011

(30) Foreign Application Priority Data

Sep. 29, 2009 (JP) ..... 2009-225422
Sep. 29, 2009 (JP) ..... 2009-225423
Sep. 29, 2009 (JP) ..... 2009-225424
Jan. 19, 2010 (JP) ..... 2010-009072

(51) Int. Cl.
*C22C 38/00* (2006.01)

(52) U.S. Cl. ..... 148/333; 267/166

(58) Field of Classification Search ..... 267/155–157, 267/166, 33–35, 286–290; 148/320–334
See application file for complete search history.

(56) References Cited

U.S. PATENT DOCUMENTS 4,448,617 A 5/1984 Yamamoto et al.
4,544,406 A 10/1985 Yamamoto et al.
5,009,843 A 4/1991 Sugimoto et al.
5,225,008 A 7/1993 Koyama et al.
5,258,082 A 11/1993 Koyama et al.
5,863,358 A * 1/1999 Krzysztalowicz ..... 148/333
5,897,717 A 4/1999 Hashimura et al.
6,017,641 A 1/2000 Aoki et al.
6,027,577 A 2/2000 Mikura et al.
6,193,816 B1 2/2001 Nakano et al.
6,375,174 B2 4/2002 Hasegawa et al.
6,406,565 B1 6/2002 Hashimura et al.
6,543,757 B2 4/2003 Imaizumi
6,550,301 B2 4/2003 Hasegawa
6,616,131 B2 9/2003 Imaizumi
6,648,996 B2 11/2003 Hasegawa
6,712,346 B2 3/2004 Imaizumi
6,779,564 B2 8/2004 Hasegawa et al.

(Continued)

FOREIGN PATENT DOCUMENTS

JP 7-292435 A 11/1995

OTHER PUBLICATIONS

Excerpt from the textbook Spring, 4th edition edited by the Japan Society of Spring Engineers 2008, p. 508.

(Continued)

*Primary Examiner* — Christopher Schwartz
(74) *Attorney, Agent, or Firm* — J-TEK Law PLLC; Jeffrey D. Tekanic

(57) ABSTRACT

A spring steel and spring having superior corrosion fatigue strength and a strength on the order of HRC 53 to HRC 56 are disclosed. The spring steel comprises a tempered martensite and 2.1 to 2.4% Si in terms of percent by mass of the total mass of the spring steel.

20 Claims, 1 Drawing Sheet

U.S. PATENT DOCUMENTS

| | | | | |
|---|---|---|---|---|
| 6,836,964 | B2 | 1/2005 | Hasegawa et al. | |
| 7,407,555 | B2 | 8/2008 | Yoshikawa et al. | |
| 7,597,768 | B2 * | 10/2009 | Suda et al. | 148/334 |
| 7,615,186 | B2 | 11/2009 | Suda et al. | |
| 7,699,943 | B2 | 4/2010 | Nakano et al. | |
| 7,776,440 | B2 | 8/2010 | Kunita et al. | |
| 2005/0173028 | A1 | 8/2005 | Suda et al. | |
| 2006/0169367 | A1 * | 8/2006 | Yuse et al. | 148/320 |
| 2006/0196584 | A1 | 9/2006 | Kochi et al. | |
| 2006/0201588 | A1 * | 9/2006 | Suda et al. | 148/333 |
| 2007/0163680 | A1 | 7/2007 | Suda et al. | |
| 2007/0256765 | A1 | 11/2007 | Kimura et al. | |
| 2008/0163957 | A1 * | 7/2008 | Brady et al. | 148/326 |
| 2008/0271824 | A1 | 11/2008 | Fujino et al. | |
| 2008/0308195 | A1 | 12/2008 | Yoshihara et al. | |
| 2009/0020189 | A1 | 1/2009 | Yoshihara et al. | |
| 2009/0020195 | A1 | 1/2009 | Kubota et al. | |
| 2009/0079246 | A1 | 3/2009 | Okura et al. | |
| 2009/0174129 | A1 | 7/2009 | Izumida et al. | |
| 2011/0074076 | A1 | 3/2011 | Kuno et al. | |
| 2011/0074077 | A1 | 3/2011 | Kuno et al. | |
| 2011/0074079 | A1 | 3/2011 | Nakano et al. | |

OTHER PUBLICATIONS

Amendment and Response to non-final Office Action mailed Apr. 25, 2012 for U.S. Appl. No. 12/892,444.

* cited by examiner

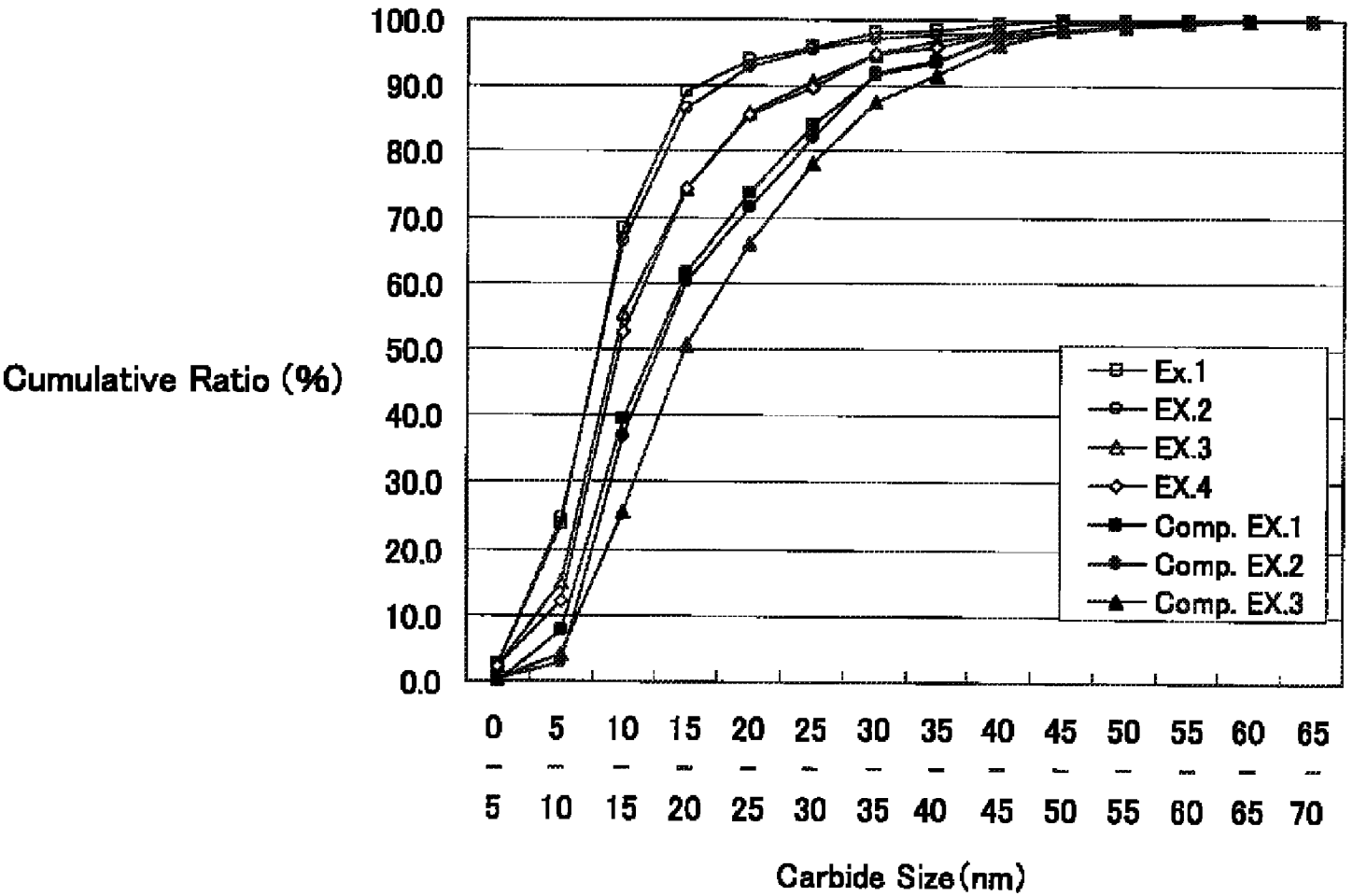
Cumulative Ratio (%)
100.0
90.0
80.0
70.0
60.0
50.0
40.0
30.0
20.0
10.0
0.0
Carbide Size (nm)
0 5 10 15 20 25 30 35 40 45 50 55 60 65
5 10 15 20 25 30 35 40 45 50 55 60 65 70
Ex.1
EX.2
EX.3
EX.4
Comp. EX.1
Comp. EX.2
Comp. EX.3

SPRING STEEL AND SPRING HAVING SUPERIOR CORROSION FATIGUE STRENGTH

CROSS-REFERENCE TO RELATED APPLICATION

This application claims priority to Japanese Patent Application Nos. 2009-225422, 2009-225423 and 2009-225424, all of which were filed on Sep. 29, 2009, and to Japanese Patent Application No. 2010-009072 filed on Jan. 19, 2010, the contents of all of which are hereby incorporated by reference into the present application.

TECHNICAL FIELD

The present teachings relate to a spring steel and a spring, and in preferred embodiments, to a spring steel and a spring having superior corrosion fatigue strength.

DESCRIPTION OF RELATED ART

In recent years, there has been a growing demand for spring steel and springs having higher strengths. In high-strength springs, however, when the hardness has been increased in order to maintain the sag resistance, the impact resistance, toughness and corrosion fatigue strength of the steel have tended to decrease. Various materials have been considered from the standpoint of optimizing these various properties. In particular, WO 2006/022009 and its English-counterpart US 2007-256765 A1 (hereinafter "Patent Document 1") discloses a spring steel that satisfies the following formulas (1) to (3):

$$1.2\% \leqq C(\%)+Mn(\%)+Cr(\%) \leqq 2.0\% \quad (1),$$

$$1.4\% \leqq Si(\%)/3+Cr(\%)/2+Mn(\%) \leqq 2.4\% \quad (2) \text{ and}$$

$$0.4\% \leqq Cu(\%)+Ni(\%) \quad (3).$$

In addition, in order to improve the corrosion fatigue strength, the spring steel of Patent Document 1 has ten or fewer inclusions, each having a diameter of 10 μm or more, per field of vision of 100 $mm^2$. The percentages in the above-mentioned formulas (1) to (3) indicate percent by mass.

However, even if the material compositions described in the above-mentioned patent document are used, it has been difficult to optimize each of the above-mentioned properties at an acceptable level and at a low cost. Therefore, an object of the disclosure of the present teachings is to provide an improved spring steel and a spring, e.g., having superior corrosion fatigue resistance.

SUMMARY

As a result of conducting studies on various spring steel alloy compositions, the inventors discovered a range of spring steel alloy compositions that, e.g., exhibit satisfactory corrosion fatigue strength or corrosion fatigue resistance (hereinafter collectively "corrosion fatigue strength") while also maintaining high strength.

In a preferred embodiment, a spring steel as provided herein includes tempered martensite, and the amount of Si contained in the steel material, in terms of percent by mass, is 2.1 to 2.4% of the total mass of the steel.

Furthermore, the term "tempered martensite" as used in the present description refers to a steel in which an austenite structure has been transformed into a martensite structure by first performing a quenching treatment, wherein the steel material is heated to a high temperature and then rapidly cooled, and by subsequently heating to a prescribed tempering temperature (a temperature lower than the temperature at which the steel is transformed into austenite), followed by cooling.

All percentages mentioned herein are mass percentages, unless otherwise indicated.

BRIEF DESCRIPTION OF DRAWINGS

FIG. 1 is a graph showing the relationship between carbide size and cumulative ratios with respect to the total number of carbides in the steel material.

DETAILED DESCRIPTION OF INVENTION

In one aspect of the present teachings, the spring steel may further satisfy the condition that the number of carbides contained in the tempered martensite, which carbides have a minimum length of less than 15 nm, is 40% or more of the total number of carbides.

Furthermore, the term "minimum length" as used in the present description refers to the length of the short side of a rectangle that can be formed along outer edges of the carbide. In case the shape of the carbide is spherical, the minimum length is equivalent to the diameter thereof. In case the carbide is needle-shaped, the minimum length is equivalent to the thickness (width) thereof.

In one aspect of the present teachings, the spring steel includes, in terms of percent by mass: 0.35 to 0.55% C, 0.20 to 1.50% Mn, 0.10 to 1.50% Cr, and one or two or three elements selected from the group consisting of 0.40 to 3.00% Ni, 0.05 to 0.50% Mo and 0.05 to 0.50% V. In addition to including these alloy components, the balance of the spring steel is one of at least substantially, predominantly or completely Fe (iron) and, e.g., no more than minor amounts of incidental elements and/or unavoidable impurities.

In addition or in the alternative, the amount of Mn contained in the spring steel may be 0.40 to 0.50%. In addition or in the alternative, the amount of Ni contained in the spring steel may be 0.50 to 0.60%.

In addition or in the alternative, after quenching and tempering, the spring steel may preferably exhibit a corrosion endurance of 40,000 oscillation cycles or more (more preferably 45,000 or more and even more preferably 50,000 or more).

In another aspect of the present teachings, a spring is also provided that comprises any one of the above-mentioned or below-mentioned spring steels.

Representative, non-limiting examples of the present invention will now be described in further detail with reference to the attached drawing. This detailed description is merely intended to teach a person of skill in the art further details for practicing preferred aspects of the present teachings and is not intended to limit the scope of the invention. Furthermore, each of the additional features and teachings disclosed below may be utilized separately or in conjunction with other features and teachings to provide improved spring steel and springs comprising the spring steel.

Moreover, combinations of features and steps disclosed in the following detail description may not be necessary to practice the invention in the broadest sense, and are instead taught merely to particularly describe representative examples of the invention. Furthermore, various features of the above-described and below-described representative examples, as well as the various independent and dependent claims, may be combined in ways that are not specifically and explicitly enumerated in order to provide additional useful embodiments of the present teachings.

All features disclosed in the description and/or the claims are intended to be disclosed separately and independently from each other for the purpose of original written disclosure, as well as for the purpose of restricting the claimed subject matter, independent of the compositions of the features in the embodiments and/or the claims. In addition, all value ranges or indications of groups of entities are intended to disclose every possible intermediate value or intermediate entity for the purpose of original written disclosure, as well as for the purpose of restricting the claimed subject matter.

In a further aspect of the present teachings, by selecting the amount of Si contained in a spring steel, which contains tempered martensite, within the range of 2.1 to 2.4%, a spring having satisfactory durability in terms of a corrosion fatigue strength or the like can be produced. Further, if the amount of Si is within the above-mentioned range, a spring steel having a desired strength, typically a strength of about HRC 53 to HRC 56, can be realized by quenching and tempering the steel material. While the above-mentioned Patent Document 1 indicates that the amount of Si contained in the steel material is 1.80 to 2.80%, the desired corrosion fatigue strength may not be obtained, and/or the amount of decarburization may undesirably increase when the steel material is rolled, as will be further discussed below. The following provides a detailed explanation of embodiments of the present teachings.

(Spring Steel)

The spring steel of the present teachings preferably contains tempered martensite, and the amount of Si (silicon) contained in the steel material is adjusted to 2.1 to 2.4%. If the amount of Si in the spring steel is within this range, it is effective for improving sag resistance, tempering properties and corrosion fatigue strength. If the amount of Si is less than 2.1%, corrosion fatigue strength readily decreases, since large-sized carbides easily precipitate in the tempered martensite. If the amount of Si exceeds 2.4%, decarburization readily occurs when rolling the steel, thereby resulting in the risk of a decrease in fatigue strength, corrosion fatigue strength or the like. The amount of Si in the spring steel is more preferably 2.2 to 2.4%, and even more preferably 2.3 to 2.4% from the viewpoint of improving the corrosion fatigue strength. In addition, a numerical value representing the "corrosion fatigue strength" is preferably obtained according to the testing method described in examples below.

(Carbide)

Carbon steel undergoes a transformation into martensite when quenched from a heated austenite. It subsequently becomes tempered martensite after heating to a prescribed tempering temperature, and carbides are present in the tempered martensite. In the spring steel, the size of the carbides present in the tempered martensite has an effect on the strength and the corrosion fatigue strength. In the spring steel of the present teachings, the number of the carbides contained in the tempered martensite, which carbides have a minimum length of less than 15 nm, is adjusted to be 40% or more of the total number of carbides. If the number of small-sized carbides, i.e. having a minimum length of less than 15 nm, increases, the number of large-sized carbides, i.e. having a minimum length of 15 nm or more, decreases accordingly. In the following explanation, carbides having a minimum length of less than 15 nm will be referred to as "small-sized carbides", while carbides having a minimum length of 15 nm or more will be referred to as "large-sized carbides".

Reducing the ratio of the large-sized carbides (to the total number of carbides) in the tempered martensite makes it possible to realize a spring steel having a superior corrosion fatigue strength while maintaining a satisfactory strength. More specifically, by adjusting the size and the ratio of the carbides to within a suitable range, as indicated above, a spring steel having a satisfactory corrosion fatigue strength while also exhibiting a strength of about HRC 53 to HRC 56 can easily be realized. Furthermore, the ratio of small-sized carbides (to the total number of carbides) in the tempered martensite is preferably 50% or more, and more preferably 60% or more.

Spring steels according to the present teachings preferably satisfy at least the above-mentioned range of the amount of Si contained therein, as well as preferably further satisfying the above-mentioned ratio of the small-sized carbides to the total number of carbides. In this case, a spring steel having a superior strength and corrosion fatigue strength can easily be obtained.

The spring steel may also contain, in percentages by mass, 0.35 to 0.55% C, 0.20 to 1.50% Mn and 0.10 to 1.50% Cr.

(C: Carbon)

The concentration of C is preferably 0.35 to 0.55%. If the concentration of C in the spring steel is within this range, a spring steel having a satisfactory strength can be obtained by quenching and tempering. If the concentration of C is less than 0.35%, a spring steel having the satisfactory strength cannot be obtained after quenching and tempering for certain aspects or applications of the present teachings. In addition, if the concentration of C exceeds 0.55%, toughness may decrease and quenching cracks may occur during water quenching. Moreover, there is also a risk of a decrease in fatigue strength and corrosion fatigue strength. The concentration of C is preferably 0.45 to 0.50%, although the preferred concentration is dependent on the other alloy components and their concentrations. If C is within this range, in addition to being easy to realize the satisfactory strength, it also becomes easy to obtain durability, including the satisfactory corrosion fatigue strength, in accordance with the relative concentrations of the other alloy components. More preferably, the upper limit of the concentration of C is 0.49% and even more preferably 0.48%. In addition, the lower limit of the concentration of C is preferably 0.46%, and more preferably 0.47%.

(Mn: Manganese)

The concentration of Mn is preferably 0.20 to 1.50%. Satisfactory corrosion fatigue strength can be obtained in the spring steel if the Mn concentration is within this range. If the concentration of Mn exceeds 1.50%, corrosion fatigue strength tends to decrease. If the concentration of Mn is less than 0.20%, strength and quenching properties tend to decrease and cracking tends to readily occur during rolling. In view of this, the upper limit of the concentration of Mn in the spring steel is more preferably 0.70%, and even more preferably 0.50% or less. The lower limit of the concentration of Mn is more preferably 0.40%.

(Cr: Chromium)

The concentration of Cr is preferably 0.10 to 1.50%. When the concentration of Cr in the spring steel is within this range, it is useful for ensuring strength and improving quenching properties. If the concentration of Cr is less than 0.10%, these effects become insufficient for certain aspects or applications of the present teachings. In addition, if the concentration of Cr exceeds 1.50%, the tempered structure becomes heterogeneous and there is greater risk of impairing the sag resistance. The upper limit of the concentration of Cr is more preferably 0.30% and the lower limit is more preferably 0.20%.

The spring steel of the present teachings preferably includes one or two or all elements selected from the group consisting of 0.40 to 3.00% Ni, 0.05 to 0.50% Mo and 0.05 to 0.50% V. More preferably, the spring steel includes all three of these elements within the above-mentioned concentrations. In this case, in addition to obtaining satisfactory toughness, satisfactory corrosion fatigue strength is also obtained for certain aspects or applications of the present teachings.

(Ni: Nickel)

The concentration of Ni is preferably 0.40 to 3.00%. When the concentration of Ni in the spring steel is within this range, it has the effect of improving corrosion resistance. If the concentration of Ni is less than 0.40%, that effect becomes insufficient for certain aspects or applications of the present teachings. If the concentration of Ni exceeds 3.00%, further improvements in the corrosion resistance are not observed, because this effect tends to peak or reach a maximum (become saturated) at about 3.00%. More preferably, the upper limit of the concentration of Ni is 1.00% or less, and even more preferably 0.60% or less. The spring steel preferably includes at least Ni from the group of Ni, Mo and V.

(Mo: Molybdenum)

The concentration of Mo is preferably 0.05 to 0.50%. When the concentration of Mo in the spring steel within this range, corrosion fatigue strength can be improved. If the concentration of Mo is less than 0.05%, this effect becomes insufficient for certain aspects or applications of the present teachings, and if the concentration of Mo exceeds 0.50%, no further improvements in the corrosion resistance are observed, because this effect tends to peak or reach a maximum (become saturated) at about 0.50%. The concentration of Mo is preferably 0.20% or less, and more preferably 0.10% or less.

(V: Vanadium)

The concentration of V is preferably 0.05 to 0.50%. When the concentration of V in the spring steel is within this range, it is effective for reducing the size of the crystal grains and for improving the precipitation hardening. If the concentration of V is less than 0.05%, this effect becomes insufficient for this purpose, while if the concentration of V exceeds 0.50%, there is a risk of carbides forming corrosion pits in the steel surface and these pits becoming the starting points of cracking fractures. In addition, toughness decreases. More preferably, the concentration of V is 0.30% or less, and even more preferably 0.20% or less. The concentration of V is still more preferably 0.10% or less.

In addition, the spring steel can include P (phosphorous). Since P tends to cause the crystal grain boundaries to become brittle, the concentration of P is preferably 0.010% or less, and more preferably 0.005% or less.

In addition, the spring steel can include S (sulfur). Since S also tends to cause the crystal grain boundaries to become brittle in the same manner as P, the concentration of S is preferably 0.010% or less, and more preferably 0.005% or less.

The spring steel can include Cu (copper). The concentration of copper in the spring steel is preferably 0.20% or less, and more preferably 0.05% or less.

The spring steel can include Ti (titanium; preferably at a concentration of 0.005 to 0.030%) in addition to the above-described alloy components. In addition, the spring steel can include B (boron; preferably at a concentration of 0.0015 to 0.0025%). In addition to including these alloy components, the balance of the spring steel is one of at least substantially, predominantly or completely Fe (iron) and, e.g., no more than minor amounts of incidental elements and/or unavoidable impurities.

(Corrosion Fatigue Strength)

An example of a cause of spring fracturing attributable to corrosion fatigue involves the formation of fine indentations (pits) in the surface of the spring due to corrosion (hereinafter "corrosion pits"), and stress subsequently concentrating in the corrosion pits. Since it is difficult to completely inhibit the formation of the corrosion pits, it is desirable if the steel material does not suffer a decrease in the fatigue strength when corrosion pits inevitably form. The corrosion fatigue resistance of the spring can be quantified according to a corrosion fatigue strength test, as will be described in detail below. More specifically, the corrosion fatigue resistance of the spring steel can be evaluated according to the number of spring oscillations it undergoes before the spring fractures or breaks during the course of the below-described corrosion fatigue strength test.

The hardness of the spring steel is preferably adjusted to an HRC of 53 to 56 after quenching and tempering. If the Rockwell hardness is within this range, a lightweight and high-strength spring can be obtained. In addition, the number of the corrosion endurance oscillation cycles of the spring steel after the quenching and tempering treatment is preferably 40,000 oscillation cycles or more, more preferably 45,000 oscillation cycles or more, and particularly preferably 50,000 oscillation cycles or more.

An explanation will now be provided of preferred methods for producing a spring using the above-described spring steel. The spring steel disclosed herein can be used to produce various types of springs by performing one or more of a known hot forming step, a cold forming step, a warm forming step, etc. For example, a representative coil spring can be produced in the following manner. Specifically, after shaping the spring steel disclosed in the present teachings into a round steel bar, a wire rod, a wire, a plate material, etc., the material can be formed into the shape of the coil, then warm shot peening can be carried out on the coil, and then hot setting (also known as a hot set process and heat setting) can be carried out on the warm shot-peened coil in order to produce the spring. A coil spring for an automobile suspension having superior sag resistance and durability can be obtained by utilizing such a production method. An example of a more specific embodiment is a coil spring for an automobile suspension that is produced using the spring steel disclosed in the present description and by carrying out steps that include one or more of coil formation, heat treatment, hot setting, warm shot peening, cold shot peening and cold setting. The coil formation step may be carried out in a hot mode (at a temperature equal to or higher than the recrystallization temperature of the wire material), in a warm mode (at a temperature lower than the recrystallization temperature of the wire material) or in a cold mode (at room temperature). In addition, various conventionally known methods can be used to form the material into the shape of a coil. For example, the coil may be formed using a coiling machine or by a method in which the material is wound around a core bar.

In the heat treatment step, heat treatment is carried out on a coil that has been formed into the shape of a coil after the above-mentioned coil formation step. The heat treatment carried out in this step differs depending on whether the above-mentioned coil formation step was carried out in the hot mode, the warm mode or the cold mode. For example, if the hot mode coil formation step was utilized, quenching and tempering are carried out on the coil. Strength and toughness are imparted to the coil by quenching and tempering. On the other hand, if the cold mode coil formation step was utilized, low-temperature annealing is carried out on the coil, which removes harmful residual stress (tensile residual stress) from the interior and surface of the coil. The quenching and tempering, as well as the low-temperature annealing, can be carried out on the coil according to any conventionally known method.

In the hot setting step, the setting is carried out with the coil at a warm temperature. The hot setting improves durability by applying a directional compressive residual stress to the coil; the sag resistance of the coil is also improved by generating a comparatively large plastic deformation in the coil. In the present example, the temperature at which the hot setting is carried out can be suitably set within a temperature range that is equal to or lower than the recrystallization temperature of the wire material and is higher than room temperature. For example, hot setting of the coil can be carried out at a temperature within the range of 150 to 400° C. As a result of carrying out the setting within such a temperature range, the amount of plastic deformation imparted to the coil can be increased and sag resistance can be improved. In addition, the amount of sag δh of the setting can be suitably determined in accordance with the total length L (total length Ls during the setting) of the automobile suspension coil spring. Furthermore, various conventionally known methods can be used for the setting process.

In the warm shot peening step, a coil that has undergone the above-described heat treatment is then subjected to warm shot peening, which improves the durability and the corrosion fatigue resistance by imparting a large compressive residual stress to the coil surface. In the present example, the temperature at which the shot peening is carried out can be suitably set within a temperature range that is equal to or lower than the recrystallization temperature of the wire material and is higher than room temperature. For example, warm shot peening treatment of the coil can be carried out at a coil temperature of 150 to 400° C. Furthermore, various conventionally known methods can be used in a steel ball shot peening method.

In the cold shot peening step, shot peening is carried out with the coil at room temperature, preferably using steel balls. The durability of the coil can be further improved by additionally carrying out cold shot peening after warm shot peening. In this case, the diameter of the steel balls used in the cold shot peening step is preferably smaller than the diameter of the steel balls used in the warm shot peening step. For example, if the diameter of steel balls used in the warm shot peening step is 1.2 mm, then the diameter of steel balls used in the cold shot peening is preferably 0.8 mm. The surface roughness of the coil can improved by performing the cold shot peening step after having imparted a large compressive residual stress in the previously-performed warm shot peening step, thereby further improving the durability and the corrosion fatigue resistance of the coil. Furthermore, various conventionally known methods can be used in the steel ball shot peening step.

In the cold setting step, the setting is carried out with the coil at room temperature. The sag resistance of the coil is further improved by carrying out the cold setting step after performing the above-mentioned hot setting step. The amount of sag δc of the cold setting can be suitably determined in accordance with the total length L (total length Ls during the setting) of the automobile suspension coil spring. Furthermore, the amount of sag δc of the cold setting is preferably less than the amount of sag δh of the hot setting.

Alternatively, the production can also be carried out by only performing the warm shot peening step and the hot setting step, while omitting both of the cold shot peening step and cold setting step described above. In addition, other steps may be included in addition to each of the above-mentioned steps. For example, a water cooling step may be carried out after the hot setting step. In addition, the warm shot peening step may be performed prior to the hot setting to achieve springs having further improved durability.

As has been explained above, according to the present teachings, a spring steel and a spring having the high strength and the superior durability in terms of the corrosion fatigue strength, etc. can be obtained. Such a spring is preferably used in components of vehicle suspension systems or the like, such as coil springs, leaf springs, torsion bar springs and/or stabilizer bars.

EXAMPLES

The following provides an explanation of examples that embody the present teachings. Furthermore, the following examples are merely specific examples for explaining the present teachings, and do not limit the present teachings or the claims.

Steels of exemplary examples and comparative examples having the chemical compositions shown in Table 1 below were each produced using the following two types of production methods. The steels of Examples 1 to 4 and Comparative Example 3 were produced according to method (2) below, while the steels of Comparative Examples 1 and 2 were produced according to method (1) below.

(1): Steel ingots, which were obtained by melting steel in a blast furnace or an electric arc furnace on a scale equivalent to a mass production, were split into slabs and rolled, followed by rolling into wire rods.

(2) After melting two tons of steel in a vacuum furnace, the melt was split into slabs and rolled, followed by rolling into wire rods.

TABLE 1

(all values are mass %)

| | C | Si | Mn | Cr | P | S | Ni | Cu | Mo | V | Ti | B |
|---|---|---|---|---|---|---|---|---|---|---|---|---|
| Example 1 | 0.48 | 2.40 | 0.45 | 0.28 | 0.004 | 0.004 | 0.53 | 0.01 | 0.09 | 0.10 | 0.024 | 0.0020 |
| Example 2 | 0.47 | 2.38 | 0.45 | 0.29 | 0.004 | 0.004 | 0.55 | 0.01 | 0.19 | 0.10 | 0.024 | 0.0020 |
| Example 3 | 0.47 | 2.18 | 0.44 | 0.29 | 0.004 | 0.004 | 0.53 | 0.01 | 0.09 | 0.10 | 0.023 | 0.0021 |
| Example 4 | 0.46 | 2.17 | 0.69 | 0.19 | 0.005 | 0.007 | 0.27 | 0.01 | 0.08 | 0.09 | 0.024 | 0.0021 |
| Comp. Example 1 | 0.47 | 2.00 | 0.70 | 0.20 | 0.005 | 0.005 | 0.55 | 0 | 0 | 0.20 | 0 | 0 |
| Comp. Example 2 | 0.60 | 2.00 | 0.90 | 0 | 0.010 | 0.010 | 0.10 | 0 | 0 | 0 | 0 | 0 |
| Comp. Example 3 | 0.48 | 1.80 | 0.70 | 0.19 | 0.006 | 0.004 | 0.27 | 0.01 | 0.10 | 0.08 | 0.018 | 0.0017 |

Testing was carried out on various properties of these steels using the methods described below.

1. Corrosion Fatigue Test (1) Test Piece Preparation

The test pieces were obtained by performing the following steps on the wire rods formed from each steel in sequence: surface polishing, heating, hot-forming the coil, oil quenching and tempering, thereby forming coil springs. Furthermore, the heating condition was high-frequency induction heating at 990° C., thereby adjusting the spring hardness (post-tempering hardness) to HRC 55. An overview of the resulting coil springs is shown in Table 2 below.

TABLE 2

| Spring shape | Wire diameter (mm) | Coil average diameter (mm) | Free length (mm) | Effective number of turns (turns) | Spring constant (N/mm) |
|---|---|---|---|---|---|
| Cylindrical | ϕ12.4 | ϕ110.9 | 323.0 | 4.05 | 39.1 |

(2) Test Method

Pits were artificially formed on the resulting springs, and a fatigue test (Japanese Automobile Standards Organization (JASO) C 604) was conducted in a corrosive environment. The pits were formed by disposing a mask having small holes on the outer surface of each spring at a location (3.1 turns from the end of the coil) where the principal stress amplitude is the greatest, and then forming hemispherical recesses (artificial pits) having a diameter of 600 μm and a depth of 300 μm by electrolytic etching. The stress concentration factor of the perpendicular stress (principal stress) in the torsion load attributable to these pits was 2.2 according to a finite element analysis. An aqueous ammonium chloride solution was used as the electrolyte. The corrosive environment consisted of corroding only the portion of the spring having the artificial pits using a misting apparatus that sprayed a 5% aqueous NaCl solution as the corrosive liquid for 16 hours, and then covering the artificial pit portion circumference with absorbent cotton impregnated with 5% aqueous NaCl solution and preventing it from drying out using an ethylene wrap. The fatigue test was conducted while the spring was in this wrapped state, and the number of oscillating cycles until the test piece broke was determined. A spring oscillating rate of 2 Hz was used in the fatigue test, and excitations were applied by parallel compression using a flat base. The test heights were determined based on a principal stress condition of 507±196 MPa that was determined as if no artificial pits were actually formed in the artificial pit portion (a height of 220 mm at the maximum load (4031 N) and a height of 270 mm at the minimum load (2079 N)). The results are collectively shown in Table 3. Table 3 also shows the amount of Si (%) contained in the steels of the Examples and the Comparative Examples.

TABLE 3

| | Amount of Si (mass %) | Number of corrosion endurance oscillation cycles (×10,000 cycles) | Ratio of small-sized carbides to total carbides (%) |
|---|---|---|---|
| Example 1 | 2.40 | 5.9 | 68.3 |
| Example 2 | 2.38 | 5.1 | 66.5 |
| Example 3 | 2.18 | 4.9 | 55.4 |
| Example 4 | 2.17 | 4.1 | 52.4 |
| Comp. Example 1 | 2.00 | 2.9 | 39.4 |
| Comp. Example 2 | 2.00 | 2.4 | 36.8 |
| Comp. Example 3 | 1.80 | 2.7 | 25.8 |

2. Measurement of Carbide Ratios (1) Test Piece Preparation

The same steel materials were used in the carbide ratio measurements as in the corrosion fatigue test. Test pieces were cut into a size of 10×5×3-5 mm from a single location at the center of a spring body; after polishing a cut surface thereof into a mirrored surface, electrolytic polishing of the cut surface was carried out using an electrolyte. An electrolyte consisting of a mixture of 8 vol % of perchloric acid, 10 vol % of butoxyethanol, 70 vol % of ethanol and 12 vol % of distilled water was used as the electrolytic polishing solution.

(2) Carbide Identification

After having polished the cut surface of the test pieces into the mirrored surface, the electrolytically polished surfaces of the test pieces were observed with a field emission—scanning electron microscope (FE-SEM). The observation of general locations was performed at a magnification of 25,000×. Subsequently, micrographs of three of the observed general locations were made and carbides were identified in the resulting images. Furthermore, the magnification during micrographic imaging was also 25,000× and the size of the micrographs was 5.13×3.82 μm.

(3) Measurement of Small-Sized Carbides

The minimum length, i.e. the width, of the carbides was measured for all identified carbides and the sizes thereof were identified. Subsequently, the identified carbides were each assigned to a width range at an interval of 5 nm based upon the identified sizes (i.e. widths of 5 nm, 10 nm, 15 nm, etc), the number of carbides within each size (width range) was counted, and the ratio of carbides of each size with respect to the total number of carbides was calculated by dividing the number of carbides of each size by the total number of carbides. The relationship between the carbide size and the cumulative ratio with respect to the total number of carbides is shown in FIG. 1. The carbide size (nm) is plotted on the horizontal axis of the graph, while the cumulative ratio with respect to the total number of carbides (%) is plotted on the vertical axis. Furthermore, FIG. 1 shows the cumulative ratios for Examples 1 to 4 and Comparative Examples 1 to 3. In addition, the ratios of carbides having a size of 15 nm or less are also shown in Table 3 for Examples 1 to 4 and Comparative Examples 1 to 3.

As shown in Table 3, Examples 1 to 4 were all determined to have a satisfactory number of corrosion endurance oscillation cycles as compared with Comparative Examples 1 to 3. Namely, the number of corrosion endurance oscillation cycles exceeded 40,000 in each of Examples 1 to 4. In particular, the number of corrosion endurance oscillation cycles exceeded 50,000 cycles in Examples 1 and 2. Moreover, the number of corrosion endurance oscillation cycles exceeded 55,000 cycles in Example 1, indicating that corrosion fatigue resistance had improved considerably in comparison with Comparative Examples 1 to 3. Examples 1 to 4 are all characterized by having Si in an amount of 2.1% or more. Examples 1 and 2 are characterized by having Si in an amount of 2.3% or more. Examples 1 to 4 are also characterized by having a cumulative ratio of small-sized carbides (to the total number of carbides) of 40% or more. In Examples 1 and 2, the cumulative ratios of small-sized carbides (to the total number of carbides) exceeded 60%. In addition, as shown in Table 1, Examples 1 to 3 are characterized by having Mn in an amount of 0.40 to 0.50%. Examples 1 to 3 are also characterized by having Ni in an amount of 0.50 to 0.60%. Furthermore, as shown in FIG. 1, the ratio of small-sized carbides (to the total number of carbides) was determined to increase as the amount of Si contained in the spring steel increased. Although the ratio of small-sized carbides (to the total number of carbides) was less than 40% when the amount of Si was 2.0%, if the amount of Si was 2.1%, the ratio of small-sized carbides (to the total number of carbides) was determined to account for the majority of the total number of carbides.

Additional teachings relevant to, and advantageously combinable with the present teachings, are found in, e.g., commonly-owned U.S. Pat. Nos. 4,448,617, 4,544,406, 5,897,717, 6,017,641, 6,027,577, 6,193,816, 6,375,174, 6,543,757, 6,550,301, 6,616,131, 6,648,996, 6,712,346, 6,779,564, 6,836,964, 7,407,555, 7,699,943, 7,776,440, and U.S. Patent Publication Numbers 2009/0079246, 2011/0074076, 2011/0074077 and 2011/0074079, the contents of all of which are hereby incorporated by reference as if fully set forth herein.

The invention claimed is:

1. A spring steel comprising in terms of percent by weight of the total weight of the spring steel:

0.35-0.55% C;
0.40-0.50% Mn;
0.10-1.50% Cr;
2.1-2.4% Si; and
0.50-0.60% Ni;
the balance being substantially Fe and incidental elements and impurities,
wherein the spring steel is a tempered martensite containing a number of carbides having a minimum length of less than 15 nm that is 40% or more of the total number of carbides contained in the tempered martensite, and
the spring steel has a Rockwell hardness of HRC 53 to 56.

2. The spring steel according to claim 1, wherein Si is contained in an amount of 2.3-2.4%.

3. The spring steel according to claim 2, wherein C is contained in an amount of 0.47-0.49%.

4. The spring steel according to claim 3, wherein Cr is contained in an amount of 0.20-0.30%.

5. The spring steel according to claim 4, further comprising 0.05-0.20% Mo.

6. The spring steel according to claim 5, further comprising 0.050-0.30% V.

7. The spring steel according to claim 6, wherein the spring steel further has:

0.010% or less P,
0.010% or less S,
0.010% or less Cu,
0.005-0.030% Ti, and
0.0015-0.0025% B.

8. The spring steel according to claim 7, wherein the number of carbides having a minimum length of less than 15 nm is 60% or more of the total number of carbides contained in the tempered martensite.

9. A spring comprising the spring steel according to claim 8.

10. A spring according to claim 9, wherein the spring is a coil spring.

11. The spring steel according to claim 10, wherein the coil spring has a corrosion endurance of at least 50,000 oscillation cycles.

12. The spring steel according to claim 1, wherein the spring steel, after quenching and tempering, has a corrosion endurance of at least 40,000 oscillation cycles.

13. The spring steel according to claim 12, further comprising at least one element selected from the group consisting of 0.05-0.50% Mo and 0.050-0.50% V.

14. A spring comprising the spring steel according to claim 1.

15. A spring according to claim 14, wherein the spring is a coil spring.

16. The spring steel according to claim 1, wherein C is contained in an amount of 0.47-0.49%.

17. The spring steel according to claim 1, wherein Cr is contained in an amount of 0.20-0.30%.

18. The spring steel according to claim 1, further comprising 0.05-0.20% Mo.

19. The spring steel according to claim 1, further comprising 0.050-0.30% V.

20. The spring steel according to claim 1, wherein the number of carbides having a minimum length of less than 15 nm is 60% or more of the total number of carbides contained in the tempered martensite.

* * * * *